US005143368A

United States Patent [19]

Kiyota et al.

[11] Patent Number: 5,143,368

[45] Date of Patent: Sep. 1, 1992

[54] PAPER DODGING DEVICE

[75] Inventors: Hirotaka Kiyota; Masaaki Nakajima, both of Chiba, Japan

[73] Assignee: Komori Corporation, Tokyo, Japan

[21] Appl. No.: 708,458

[22] Filed: May 31, 1991

[30] Foreign Application Priority Data

Jun. 25, 1990 [JP] Japan ..... 2-66009[U]

[51] Int. Cl.[5] ..... B65H 29/66

[52] U.S. Cl. ..... 271/202; 271/182; 271/216; 101/240

[58] Field of Search ..... 101/240; 271/182, 183, 271/202, 178, 312, 216

[56] References Cited

U.S. PATENT DOCUMENTS

| | | | |
|---|---|---|---|
| 3,336,028 | 8/1967 | Schonmeier | 271/202 |
| 3,941,374 | 3/1976 | Vits | 271/183 |
| 3,998,141 | 12/1976 | Hsiue | 271/187 |
| 4,364,552 | 12/1982 | Besemnn | 271/182 |
| 4,824,092 | 4/1989 | Kriefall et al. | 271/183 |
| 4,969,640 | 11/1990 | Littleton | 271/182 |
| 5,000,436 | 3/1991 | Holmes | 271/178 |
| 5,014,975 | 5/1991 | Hamricke | 271/216 |
| 5,039,082 | 8/1991 | Littleton | 271/182 |

FOREIGN PATENT DOCUMENTS

| | | | |
|---|---|---|---|
| 74091 | 1/1918 | Austria | 271/216 |

*Primary Examiner*—Eugene H. Eickholt

*Attorney, Agent, or Firm*—Abelman, Frayne & Schwab

[57] ABSTRACT

In a paper dodging device having a pair of upper and lower high-speed belts for feeding paper onto a low-speed paper, the delivery side of the upper high-speed belt is overlapped above the inlet side of the low-speed belt, and a snubber is disposed above the inlet side of the low-speed belt, the snubber having an outer diameter gradually increasing towards the rear side with respect to the rotational direction of the snubber and having paper dropping portions formed at the outer peripheral end of increasing diameter for peeling the rear end of paper from the upper high-speed belt. When paper is fed from the high-speed belts onto the low-speed belt, the paper is dropped by the outer peripheral surface of increasing diameter of the rotating snubber, and the rear end of paper is peeled by the paper dropping portion and correctly dropped onto the low-speed belt, thereby preventing contact between foregoing paper and following paper and thus preventing generation of flaws or paper jamming.

6 Claims, 5 Drawing Sheets

PAPER DODGING DEVICE

FIELD OF THE INVENTION

This invention relates to a paper dodging device for a paper delivery of a web offset printing press to regulate vertical relative position relation between a foregoing sheet and a following sheet.

BACKGROUND OF THE INVENTION

A rolled web offset printing press is provided with a folder, which, after printing, for example, folds dried and cooled web in the width direction and cuts to a predetermined length each. In this folder, it has been usual that complete signatures transported intermittently one by one are dropped onto a delivery conveyer, and stagger-stacked and delivered. A sheeter is a device to cut web into sheets and stack them evenly.

The sheeter has upper and lower high-speed belts to supply signatures and a low-speed belt to receive the signatures from the high-speed belts and transport them, and the delivery side of the upper high-speed belt is disposed above the inlet side of the low-speed belt. Signatures cut in a predetermined length are transported by the pair of high-speed belts and fed onto the low-speed belt. The transportation speed is retarded, signatures fed onto the low-speed belt are stagger-stacked, transported at a low speed and delivered.

Signatures are transported being held between the upper and lower high-speed belts, and dropped onto the low-speed belt. At this moment, in the above-described prior art paper delivery, signatures tend to adhere to the lower surface of the upper high-speed belt, and do not drop at a predetermined position on the low-speed belt. If this occurs, signatures may contact with following signature to be scratched, or cannot be correctly stagger-stacked, causing a paper jamming.

With a view to eliminate such prior art problems, it is a primary object of the present invention to provide a paper dodging device which ensures correct transportation of signatures, thereby increasing the operation speed of a web offset printing press.

SUMMARY OF THE INVENTION

In accordance with the present invention which attains the above object, there is provided a paper dodging device comprising a pair of upper and lower high-speed belts for feeding paper to a low-speed paper, a delivery side of the upper high-speed belt being overlapped above an inlet side of the low-speed belt, and a rotatable snubber disposed above the inlet side of the low-speed belt for maintaining a vertical position relation between foregoing paper and following paper, the snubber having an outer diameter gradually increasing towards the rear side with respect to the rotational direction of the snubber and having paper dropping portions formed at the outer peripheral end of increasing diameter for peeling a rear end of paper from the upper high-speed belt.

When paper is fed from the pair of high-speed belts onto the low-speed belt, the paper fed is dropped down by the outer peripheral surface of the rotating snubber increasing in diameter towards the rear side of the rotational direction, and the rear end of the paper is peeled by the paper dropping portion from the upper high-speed belt, thereby correctly dropping the paper onto the low-speed belt.

DETAILED DESCRIPTION OF THE INVENTION

An embodiment according to the present invention will now be described in detail with reference to the drawings.

Figure 7:
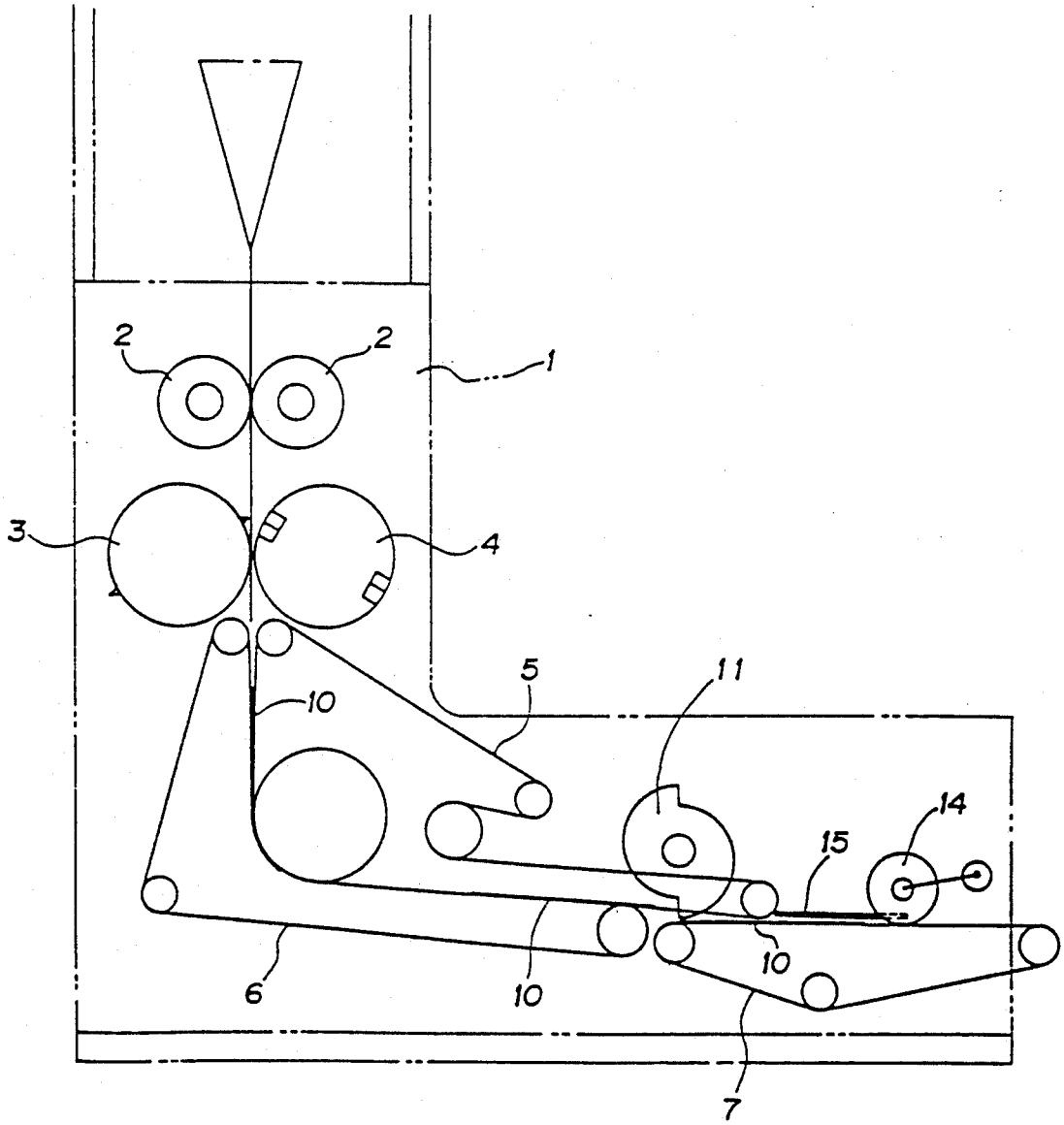
FIG. 7 is a schematic view of a paper delivery equipped with the paper dodging device.

As shown in FIG. 7, a pair of nipping rollers 2, a cut-off cylinder 3, a bearing cylinder 4, a pair of upper and lower high-speed belts 5 and 6, and a low-speed belt 7 are disposed between right and left frames 1 of a folder, in this order along the flowing direction of a signature 10.

A plurality of the low-speed belts 7 are disposed as a set between the right and left frames 1, and the delivery side of the upper high-speed belt 5 is overlapped over a predetermined length above the inlet side of the low-speed belts 7.

Figure 1:
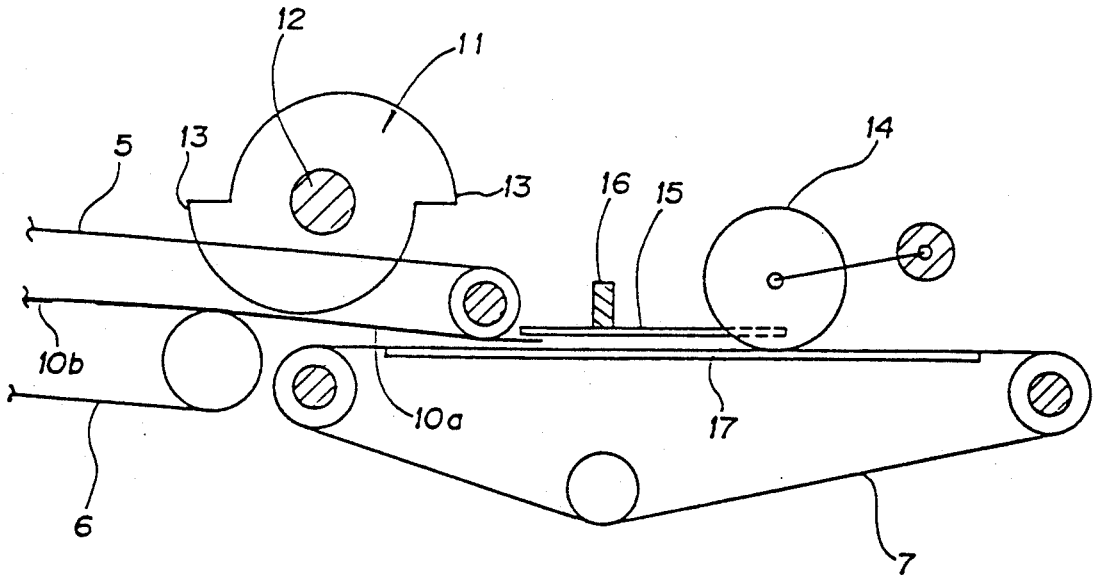
FIG. 1 is a schematic front view of an embodiment of the paper dodging device according to the present invention.
Figure 2:
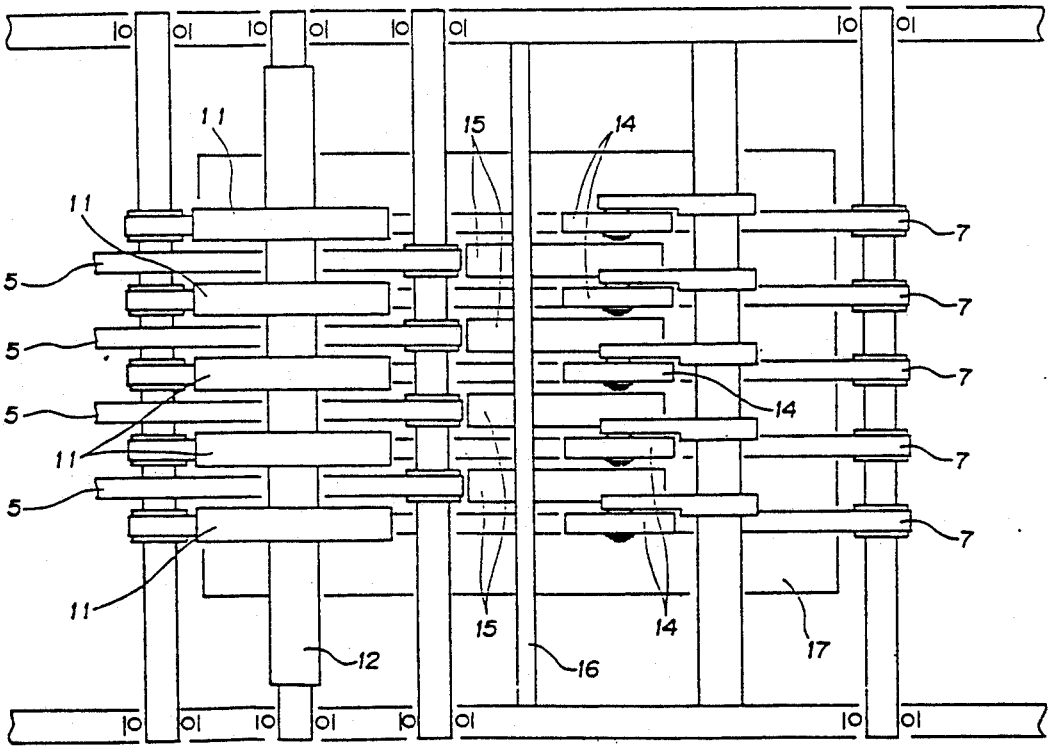
FIG. 2 is a schematic plan view of the embodiment.

As shown in FIG. 1 and FIG. 2, above the inlet side of the low-speed belt 7 is provided a snubber 11 to maintain the vertical position relation between foregoing signature 10 and following signature 10.

Figure 3:
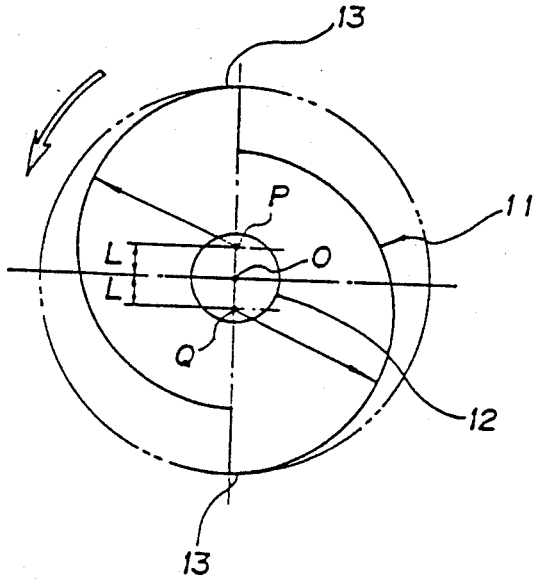
FIG. 3 is a schematic front view of a snubber.

This snubber 11, as shown in FIG. 3, is rotatably supported on a rotary shaft 12 and rotated in association with the high-speed belts 5 and 6. Its peripheral halves are 180-degree symmetrical about a rotational center O, that is, the halves are individually arcs of a radius R about points P and Q, which are away from the center O by a distance L. Therefore, the outer diameter of the snubber 11 is formed to gradually increase towards the rear side with respect to the rotational direction (arrow in FIG. 3).

Figure 5:
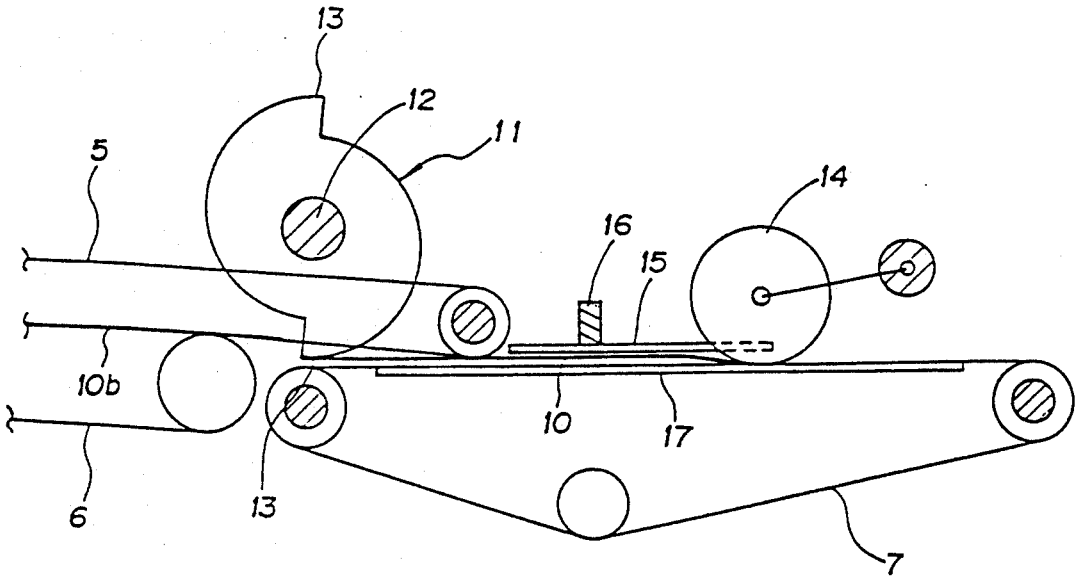

The snubber 11, at its increasing-radius ends of individual outer peripheral surfaces, is formed with paper dropping portions 13 to peel rear end of transported signature 10 from the upper high-speed belt. The paper dropping portion 13 at its low position, as shown in FIG. 5, is protruded beneath the upper high-speed layer. The peripheral speed of the largest-diameter portion of the snubber 11 is set a little slower than the transportation speed of the signature 10.

Above the delivery side of the low-speed belt 7 is provided a braking roller 14 to staggeredly stack signatures 10 on the low-speed belt 7.

Furthermore, above the low-speed belt 7 located between the snubber 11 and the braking roller 14 is provided a paper guide 15 to guide signatures 10. The paper guide 15 comprises a plurality of elongate rectangular plates mounted to a supporting plate 16 disposed on the frame 1.

A supporting table 17 to support the low-speed belt 7 is provided opposite to the paper guide 15.

Thus, as shown in FIG. 7, web formed by the former is passed between the nipping rollers 2 and cut by the cut-off cylinder 3 and the bearing cylinder 4 into signatures 10 of a predetermined length. The signatures 10 are transported with predetermined pitches by the pair of upper and lower high-speed belts 5 and 6, and supplied to the low-speed belt 7.

Figure 4:
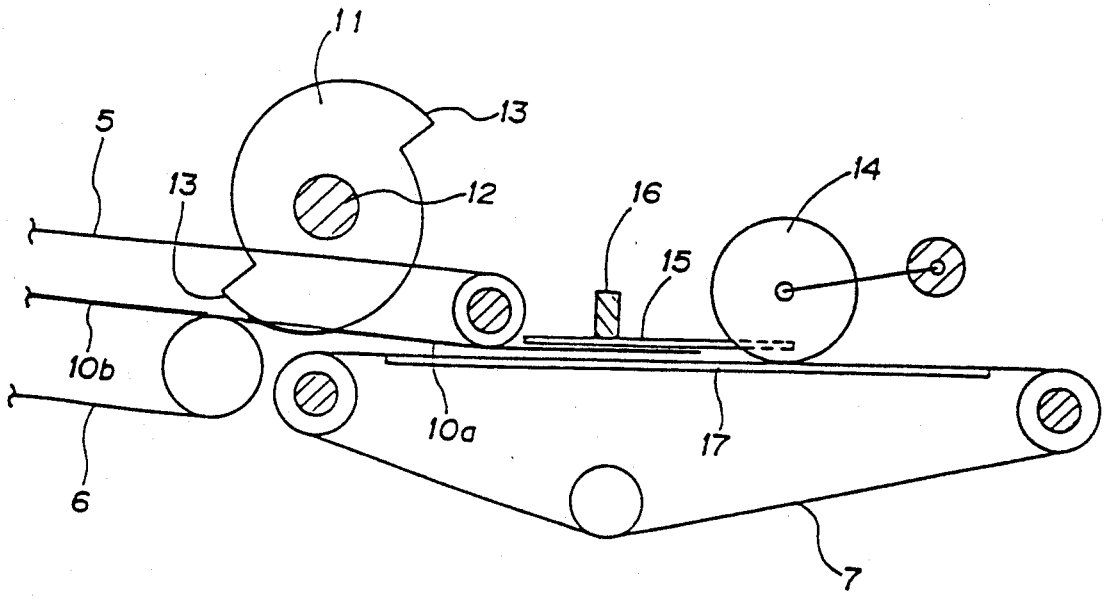
FIG. 4 to FIG. 6 are schematic views explaining the operation principle.

A foregoing signature 10*a*, as shown in FIG. 1, is located between the high-speed belts 5 and 6. At this moment, the snubber 11 rotates, and, as shown in FIG. 4, the signature 10*a* is dropped onto the low-speed belt 7 by the outer peripheral surface increasing in diameter towards the rear side with respect to the rotational direction of the snubber 11.

As the signature 10*a* is further transported and the snubber 11 rotates, as shown in FIG. 5, the rear end of the signature 10*a* is peeled by the paper dropping portion 13 of the snubber 11, and correctly dropped onto the low-speed belt 7.

Figure 6:
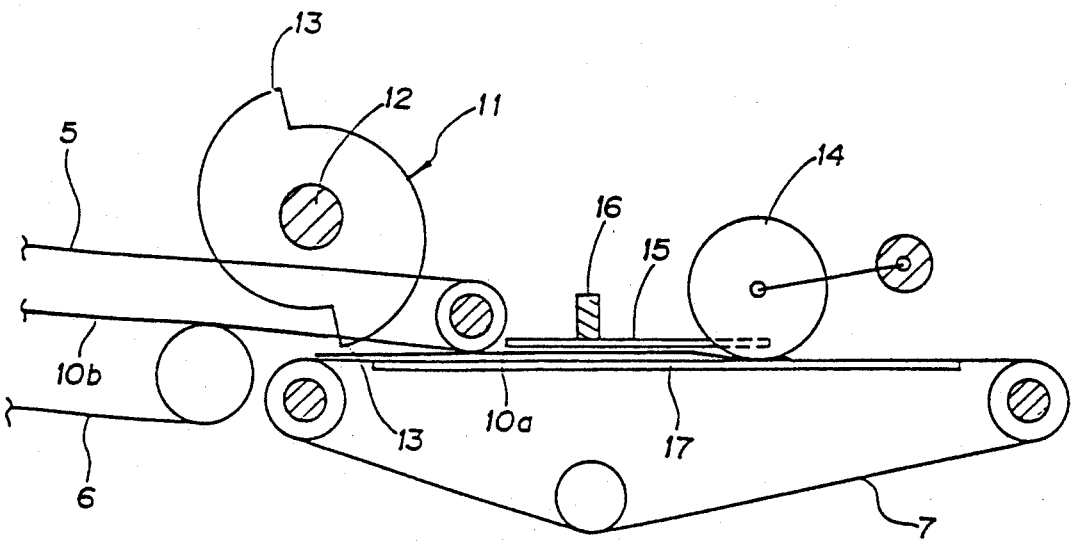

At this moment, a following signature 10*b* is transported to a position where its front end is below the snubber 11, but the rear end of the foregoing signature 10*a* is already dropped onto the low-speed belt 7, preventing interference with each other. Thus, as shown in FIG. 6, paper dodging is achieved between the signature 10*a* and the signature 10*b*.

The signature 10*a* dropped onto the low-speed belt 7 is guided by he paper guide 15 until its front edge reaches the braking roller 14. At this point the signature 10*a* is retarded, the signature 10*b* is stagger-stacked on the signature 10*a* and delivered.

In this embodiment, the folder is described as a paper delivery equipped with the paper dodging device according to the present invention. However, alternatively, the same effect can be achieved by using a sheeter which has the same arrangement and makes only cutting without holding.

As described above in detail with reference to the embodiment, in the paper dodging device according to the present invention, the delivery side of the upper high-speed belt of a pair of upper and lower high-speed belts is overlapped above the inlet side of the low-speed belt, and the snubber to maintain the vertical position relation between a foregoing paper and a following paper is disposed above the inlet side of the low-speed belt, the snubber having a diameter gradually increasing towards the rear side with respect to the rotational direction of the snubber and having paper dropping portions formed on its outer peripheral end to peel the rear end of paper from the upper high-speed belt. Therefore, paper is positively dropped onto the low-speed belt by the function of the snubber, thereby preventing contact between the foregoing paper and the following paper and thus preventing generation of flaws or paper jamming. As a result, positive paper dodging is achieved to enable high-speed operation of the web offset printing press.

We claim:

1. A paper dodging device comprising a pair of upper and lower high-speed belts for feeding paper to a low-speed paper, a delivery side of said upper high-speed belt being overlapped above an inlet side of said low-speed belt, and a rotatable snubber disposed above the inlet side of said low-speed belt for maintaining a vertical position relation between foregoing paper and following paper, said snubber having an outer diameter gradually increasing towards the rear side with respect to the rotational direction of said snubber and having paper dropping portions formed at the outer peripheral end of increasing diameter for peeling a rear end of paper from said upper high-speed belt.

2. The paper dodging device of claim 1 wherein said snubber is formed 180-degree symmetrical about its rotational center.

3. The paper dodging device of claim 1 wherein a paper dropping portion formed on said snubber is protruded below said upper high-speed belt when transporting paper to peel a rear end of paper from said upper high-speed belt.

4. The paper dodging device of claim 1 wherein a peripheral speed of a largest-diameter portion of said snubber is set slower than a paper transportation speed.

5. The paper dodging device of claim 1 further comprising a braking roller disposed above a delivery side of said low-speed belt for retarding transported paper and staggeredly stacking it on said low-speed belt.

6. The paper dodging device of claim 1 wherein transported paper is a signature.

* * * * *